United States Patent [19]

de Almeida

[11] 4,307,654

[45] Dec. 29, 1981

[54] FILLING AND EXHAUST VALVE FOR THE CONTROL OF THE HYDRAULIC FLOW ON PRESSES AND SHEARS

[75] Inventor: Antonio A. R. de Almeida, Porto, Portugal

[73] Assignee: Inter-Hydraulik AG, Berneck, Switzerland

[21] Appl. No.: 69,918

[22] Filed: Aug. 27, 1979

[30] Foreign Application Priority Data

Aug. 29, 1978 [DE] Fed. Rep. of Germany ..... 2837666

[51] Int. Cl.[3] ..... F15B 13/04; F15B 11/02

[52] U.S. Cl. ..... 91/441; 251/63.4; 251/63.6; 251/83

[58] Field of Search ..... 91/441; 251/63.4, 63.6, 251/83

[56] References Cited

U.S. PATENT DOCUMENTS 3,477,466 11/1969 Sturm ..... 251/63.4 X

*Primary Examiner*—Gerald A. Michalsky

*Attorney, Agent, or Firm*—Hopgood, Calimafde, Kalil, Blaustein & Judlowe

[57] ABSTRACT

An improved filling and discharge valve for use with a hydraulic cylinder is provided, the valve comprising a valve body having a first chamber therein supporting a spring-biased main valve piston having an extending portion containing a chamber in which a second spring-biased valve is supported, the valves operationally being interdependent and being capable of being coupled to a hydraulic cylinder so as to control the flow of oil from oil-storage means to said hydraulic cylinder and back to said oil-storage means according to a predetermined working cycle. Control valves and switches are provided to control the operation of the filling and discharge valve.

6 Claims, 6 Drawing Figures

FILLING AND EXHAUST VALVE FOR THE CONTROL OF THE HYDRAULIC FLOW ON PRESSES AND SHEARS

This invention relates to a filling and discharge valve for the control of hydraulically operated presses and bending machines. The subject matter of the invention is a new filling and discharging valve for controlling of the direct flow movement between the piston chamber of a working cylinder and the tank in hydraulically operated machines with prefilling systems in particular for hydraulic presses and bending machines.

A conventional filling and discharging valve is a special type of a hydraulic valve which is used in conjunction with hydraulic working cylinders the first function of which consists in allowing the hydraulic liquid to flow directly from the tank into the working cylinders when the piston rod of the working cylinder is subjected to a negative force, that is, when it is drawn out by loading instead of thrusting against an opposite force. During this course of movement the filling valve opens automatically and allows a free flowing through of the hydraulic liquid from the tank into the piston chamber of the working cylinder.

A second function of known filling and discharge valves consists in that the hydraulic liquid is delivered from the working cylinder into the tank whilst the piston movement is reversed, that is, during a return stroke. For the control of this movement the filling and discharge valve is opened by means of a hydraulic operating cylinder which is fed with an oil flow produced by an auxiliary pump controlled by a valve.

With the last mentioned function (return stroke) a still higher hydraulic pressure is maintained during the return phase of the working piston. Upon a sudden opening of the filling and discharge valve a pressure thrust is caused. This pressure thrust occurs as a rule always with the reversal of working pistons loaded with hydraulic high pressure.

This phenomenon can be obviated in that the opening of the after suction valve is carried out in two stages, namely, in a decompression stage during which the oil pressure is discharged through a number of small holes and a following discharge stage which cuts off the actual oil flow.

This two stage operation is achieved by the successive opening of two different sized conical valves. The first smaller conical valve is accommodated in the body of the larger conical valve. The control of the two conical valves is effected by means of the piston rod of an operating cylinder which, as already mentioned is controlled by means of a separate oil flow. The resetting of the piston of the operating cylinder is effected by means of a strong helical spring. The operating time of such conical valves is dependent on the quantity of oil flowing through and the pressure level of the outer hydraulic source of energy, whilst the pressure reduction speed during the decompression phase is determined by the variable dimensions of the pressure discharge bores.

The invention has as its object to further develop a filling and discharge valve such that a control oil flow from an auxiliary pump can be omitted and further more influences the pressure reduction speed during the decompression phase and the pressure level for the commencment of the free discharge can be determined. The problem has been solved by the invention described in claims 1 to 4.

The following advantages are achieved:

1.1. For the control of the filling and discharge valve the necessity of the supply of oil from outside is rendered unnecessary therefore neither a precontrol pump is required nor must an oil current be taken from the main pump for the changing over the working cylinders at the lower reversing point.

1.2. The speed of the pressure reduction can be influenced during the decompression phase.

1.3. The pressure level at which the decompression phase terminates and the full opening can be adjusted at which the oil flow discharge takes place.

1.4. The filling and discharge valve is characterised by a simultaneous operation of two or several hydraulic cylinders which are operated in parallel.

Further features and advantages of the invention are the subject matter of the subclaims. The invention will be described with reference to the accompanying drawings showing several embodiments.

2.1. DESCRIPTION OF THE NEW VALVE (FIG. 1)

Figure 1:
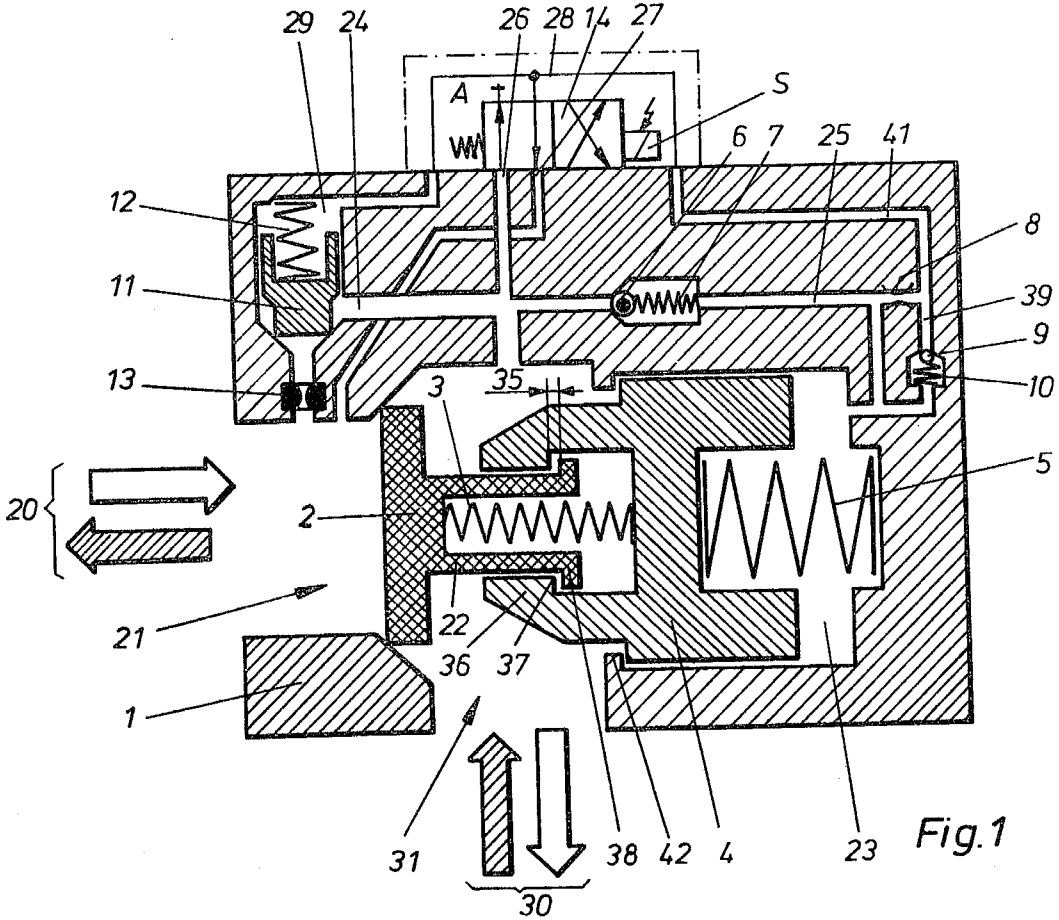
FIG. 1 shows an axial section drawn diagrammetically through a filling and discharge valve according to the invention.

The filling and discharge valve (50, FIG. 2) consists of a valve body 1 with two main openings 21 and 23 which are arranged on the front faces at an angle of 90° to one another. One of them 21 leads to the connection to the tank 20 by means of a fixed or flexible pipe and the other 31 serves for the application directly above or at the side of the working cylinder 30.

The valve body 1 is fixed by means of screws on the working cylinder 30. The plate valve 2 which is held against its seating by means of a weak spring 3 ensures that oil flows from the tank connection opening 11 to the cylinder connection opening 31 when there is a small negative pressure in proportion to the normal atmospheric pressure in the tank 20, in the piston chamber 32 of the working cylinder 30.

The plate valve 2 which is formed as a non return valve prevents in the uncontrolled state a return of oil from the cylinder connection opening 31 to the tank closure opening 21.

The shaft 22 of the plate valve 2 is guided in the outer end bore of a main piston valve 4 which can be moved in a valve cylinder 23 which is worked in the valve body 1 of the filling and discharge valve 50. The cylinder axis, the plate valve axis and the axis of symmetry of the tank connection opening 21 are coaxial or geometrically in a straight line. The main piston valve 4 has a somewhat greater angle than the angle of the plate valve (2) and is held in its stop (42) at the end of the stroke by means of a spring (5) stronger than the spring (2) of the plate valve.

An oil passage—which from now on will be called the "decompression passage 24"—consists of the cylinder connection opening 31 to the tank connection opening 21 by means of a precontrolled two way valve seat (11) and a throttle (13) in the form of an exchangeable perforated plate or an adjustable throttle. This two-way valve seat (11) is normally closed by means of a coiled spring (12). The essential feature of the present invention is therefore the fact that it concerns a controlled filling and discharge valve. Another oil passage exists between the cylinder connection opening 31 and the valve cylinder chamber 23; this passage goes through a counter pressure valve 6,7 and is in future called a "precontrol passage 25".

The filling and discharge valve 50 is controlled by an electrically operated standardized 3-way-2-position valve (control valve 14). The position of this control valve 14 determines the manner of operation of the filling and discharge valve, namely the feeding of oil from the tank 20 into the working cylinder 30 whilst its rapid passage or fixed closing during the working stroke and free flowing passage of oil from the working cylinder 30 to the tank 30 during the return.

For reasons of safety the latter position agrees with the position of the control valve 14.

The inlet connection 26 of the control valve 14 is connected to the cylinder connection opening 31 whilst its return flow connection 27 communicates with the tank connection opening 21 of the filling and discharge valve 50 in that the consumer connection 28 is connected to the control chamber 29 of the valve seat 11 and the valve cylinder chamber 23. The latter passage goes alternatively through a small precontrol throttle 8 or through a non return valve 9,10 on the discharge side of the valve cylinder chamber 23.

2.2. OPERATION OF THE NEW FILLING AND DISCHARGE VALVE

The following described operations include the fact that at the hydraulic working cylinder 30 on or at which the filling and discharge valve 50 is fixed, develops a higher speed than the corresponding oil flow of the system pump during the commencing phase of the forward stroke. Otherwise a filling valve would not be required. As is known this effect can be realized by gravity or even by auxiliary cylinders etc., the actual method used is immaterial in so far as it relates to the filling valve.

Figure 2:
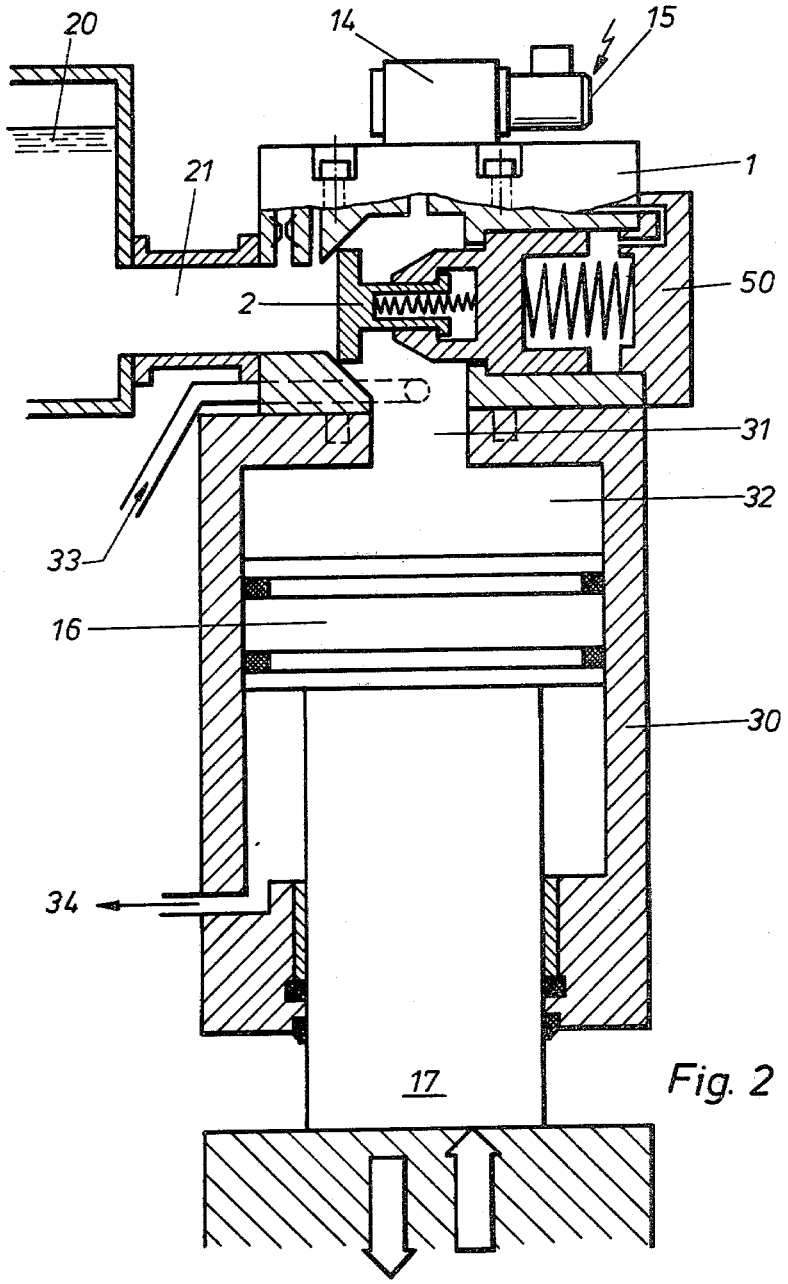
FIG. 2 shows a longitudinal section through a hydraulic cylinder with a filling and discharge valve arranged therein.

The control valve 14 is at the same time excited at the beginning of the forward movement of the working piston 16 (FIG. 2). Consequently the inlet connection (26, FIG. 1) of the control valve 14 is connected to the control chamber 29 of the two-way valve seat 11 and to the valve cylinder chamber 23 of the piston valve 4 by means of the non return valve 9,10. Because the inlet connection 26 of the control valve 14 is in direct connection with the piston chamber (32, FIG. 2) of the working cylinder 30 each rapid pressure increase therein, is promptly transmitted to the valve cylinder chamber 23 by means of the above mentioned non return valve 9,10.

The initially high forward speed of the working piston (16, FIG. 2) causes a suction action, that means, the pressure in the piston chamber 32 decreases under the inside pressure of the tank and the atmospheric pressure and the oil in the tank 20 is then forced to flow through the filling valve 50 in the working cylinder 30 as the pressure deviation although small is sufficient to develop a force which overcomes the pretension of the spring 3 and lifts the valve plate of the plate valve 2 from its seating.

A negative pressure in the piston chamber 32 of the working cylinder 30 has no influence on the piston valve of the filling and discharge valve 50 and the two way valve seat 11 as their corresponding springs 5,12 have sufficient tension.

When the piston rod 17 of the working cylinder 16 meets a workpiece, pressure builds up in the piston chamber 32 of the working cylinder 30.

The increasing pressure over the inside pressure of the tank ensures automatically the firm closing of the plate valve 2. Actually the conical plate valve 2 is pressed against its seating with a force proportional to the relative pressure in the piston chamber 32 of the working cylinder 30.

The forward movement of the working piston 16 continues now corresponding to the output of the pump which is fed into the working cylinder 30 (upper feed bore 33, FIG. 2). The inner arrangement of the new filling and discharge valve 50 permits an advantageous constructional detail, namely that the feed bore 33 can be found in the valve body 1 which leads the oil from the pump to the piston chamber 32 of the working cylinder 30. Hereby the accommodation of the tube screw is simplified and the necessity for a second opening in the upper cylinder base is obviated.

At the end of the working stroke the control valve 14 is pressureless and returns again in its normal resting position (zero position). The control chamber 29 of the two way valve seat 11 is consequently free of pressure and the differential piston of the valve seat 11 is opened by the pressure in the piston chamber 32 of the working cylinder 30 in order to relieve the compressed oil in the piston chamber 32 of the working cylinder 30 via the throttle 13. The oil flows through the decompression passage 24 as described under 2.1 and the pressure is reduced progressively in dependence on the dimensions of angle of the throttle 13.

By varying the throttle 13 (for example, by changing the perforated shutter) it is then possible to vary the time which is required for the relieving of the pressure from the working pressure down to a predetermined level. The lower the actual pressure the shorter the relieving time. During the decompression the plate valve 2 is closed by reason of the following circumstances:

(a) the pressure in the cylinder connection opening 31 forces an oil current through the precontrol passage 25 (in which the counter pressure valve 6,7 is contained) to the valve cylinder chamber 23 and from this via the precontrol throttle 8 and to the precontrol valve 14. (direction of the consumer connection 28 return flow connection 27) to the tank connection opening 21. This oil current produces in the valve cylinder chamber 23 a precontrol pressure Pi which corresponds to the working cylinder pressure Pz minus the pressure drop $\Delta P$ of the counter pressure valve 6,7.

(b) the valve plate of the plate valve 2 is pressed against its seating by the spring force of the plate valve (f,-spring 3) and the action of the pressure produced in the working cylinder 10 and so long as the gap 35 does not drop to zero.

(c) the main valve piston 4 is subjected on its plate valve side to the working cylinder pressure Pz and in the control chamber 23 to the precontrol pressure Pi. As the working cylinder pressure Pz on the plate valve side of the main valve piston 4 is higher than the precontrol pressure Pi in the control chamber 23 (as described under a), a return on the main valve piston 4 is effected the gap 35 is reduced to zero and the closing force of the plate valve 2 is reduced.

Figure 4:
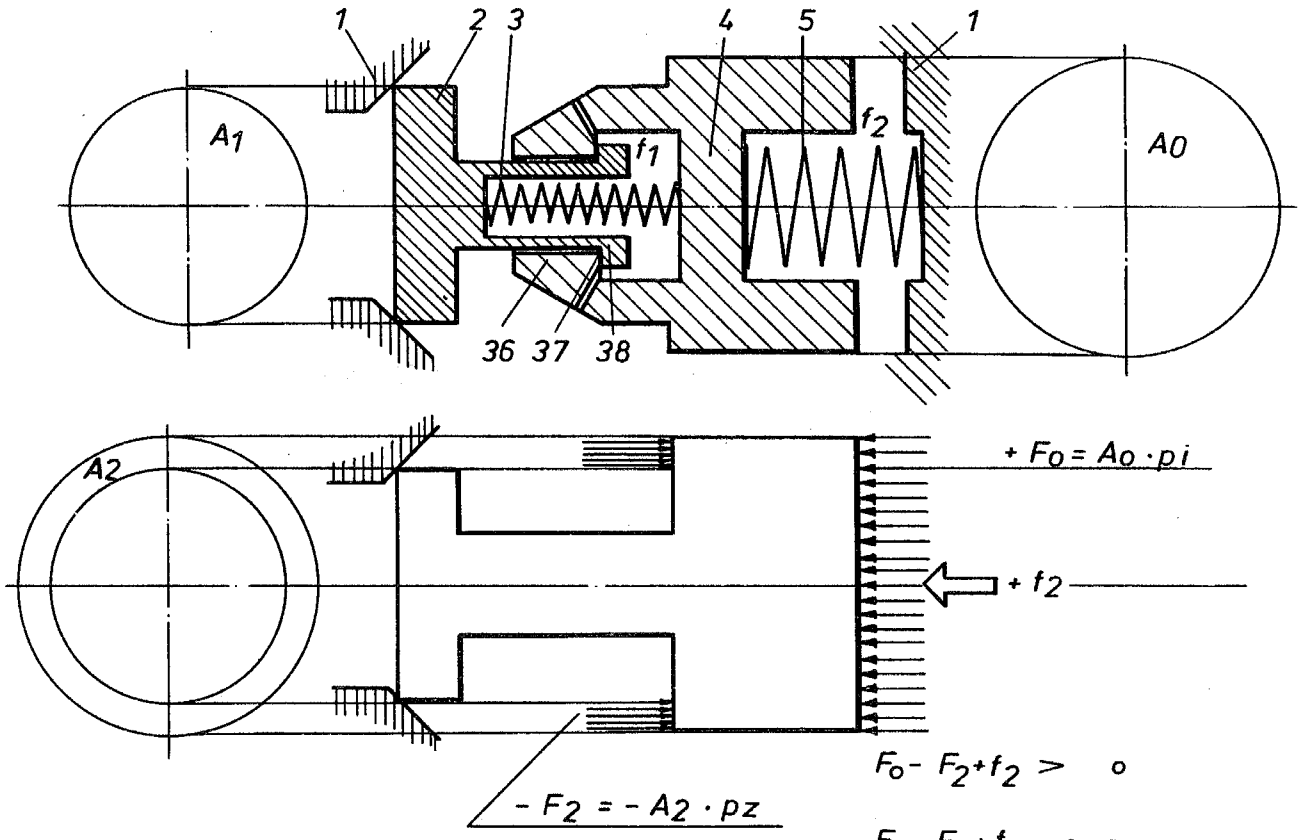
FIG. 4 shows drawn diagrammatically the surface ratios of valve plate and valve piston as a core member of the new filling and discharge valve.

(d) The procedure described under point (c) results in the plate valve 2, which is guided in the main valve piston 4 and the main valve piston 4 behaving like a single part (FIG. 4) which is under the influence of a resulting force which can be expressed mathematically as follows:

$$R=F_o-F_2+f_2=A_o\cdot P_i-A_2\cdot P_z+f_2$$

in which the letters signify:

R=resulting force which holds the plate valve 2 pressed against its seating, $F_0$=force on the face $A_o$ of the main valve piston 4

$P_z$=force on the piston differential face $A_2$ $f_2$=force on the spring 5 of the main valve piston 4

$A_o$=piston cross section face of the main valve piston 4

$A_2$=piston differential face, that is, piston face $A_o$ of the main valve piston 4 minus seating face A, of the plate valve 2

$P_i$=precontrol pressure which exists in the valve cylinder chamber 23 behind the main valve piston 4.

$P_z$=pressure in the working cylinder 30

Because the precontrol pressure $P_i$ corresponds to the working cylinder pressure $P_z$ minus the pressure drop ΔP of the counter pressure valve 6,7 as stated under (a) the magnitude of the resulting force R on the plate valve 2 can be expressed by the formula:

$$R=A_o\cdot(P_z-\Delta P)-A_2\cdot P_z+f_2$$

The formula for R may be described as below when the piston differential face $A_2$ is expressed as the difference between the piston face $A_o$ and the plate valve seating face $A_1$:

$$R=A_1\cdot(P_z-A_o/A_1\cdot\Delta P+f_2/A_1)=A_1\cdot(P_z-P_a)$$

The formula shows that the resulting force R is negative when the cylinder pressure $P_z$ with progressive decompression is lower than the magnitude of the parameter $$P_a=A_o/A_1\cdot\Delta P-f_2/A_1$$

As a consequence the plate valve 2 is no longer pressed against its seating but it rises and allows oil to flow to the tank 20 from the cylinder 30.

The value of the parameter $P_a$ may be determined by varying the ΔP value, that is, by adjusting the counter pressure valve 6,7 and as the $f_2/A_1$ value—specifically sprung force of the valve piston spring—from the construction is small, the $P_a$ value practically proportional to P.

Accordingly the pressure level may be predetermined at which the decompression phase ends and the discharge commences. That is one of the most essential features of the present invention.

2.3. BASIC ADVANTAGES OF THE NEW FILLING AND DISCHARGE VALVE

According to the description under 2.1 and operation under 2.2 the invention provides the following basic advantages:

2.3.1. No precontrol pump is necessary in order to feed oil oil to the valve release.

This means (a) Economical savings of an expensive part and pipes and fittings belonging there to.

(b) Additional reliability by elimination of danger of precontrol errors.

(c) Choice of the operating time not dependent on an external precontrol.

2.3.2. No branching off of an oil flow from the main pump for precontrol purposes.

This means:

(a) full pump delivery output available for the reversal and return of the working piston 16.

(b) gentler and quicker operations of the working cylinder 30.

2.3.3. Possibility of adjusting the duration of the decompression.

This means:

(a) control of the freeing of the resilient energy for a minimum time and inspect free work.

(b) optimum decompression adjustment to the maximum working pressure, cylinder volume, piston working range and speeds and suspension of the machine frame.

2.3.4. Possibility of adjusting the pressure level at which the full discharge commences.

This means:

(a) control of the optimum pressure level at which the decompression phase ends in order to adjust to the hydraulic characteristics of the machine in particular with respect to piston speeds and piston ratio.

(b) gentle valve opening because the opening force increases progressively from zero.

(c) reduction of the total decompression time in conjunction with the aformentioned advantage for the most rapid reversing and maximum stroke number per unit of time.

FURTHER SPECIAL PROPERTIES OF THE NEW CONCEPT 2.4.1. Possibility of eliminating the individual control valves.

During the forward stroke of the working piston 16 the pressure $P_z$ existing in the working cylinder 30 is exercised on the control chamber 29 of the valve seat 11 and likewise on the valve cylinder chamber 23.

Figure 3:
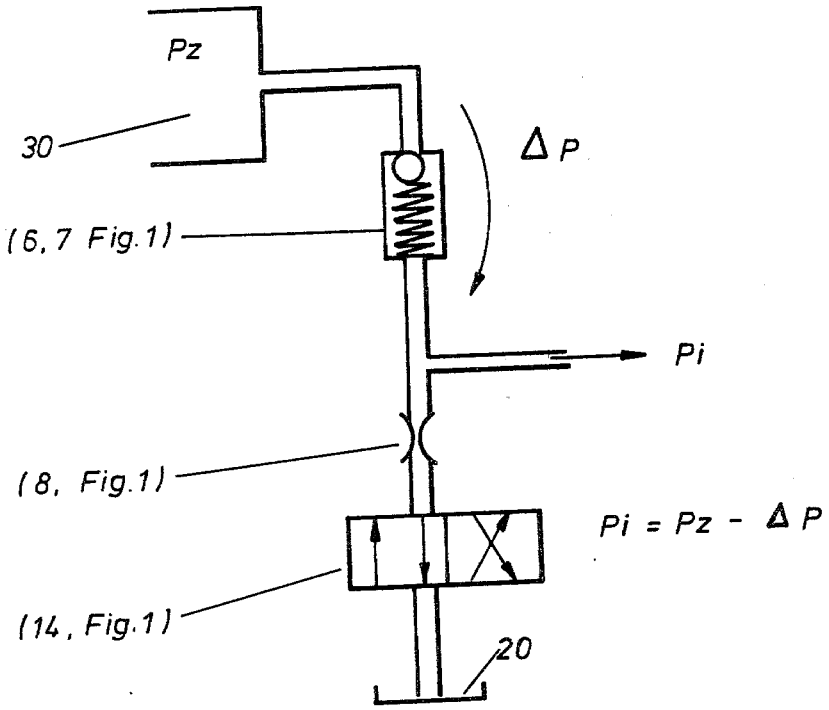
FIG. 3 shows a diagrammatic drawing of the flow movement between the working cylinder connection and the tank for producing the precontrol pressure.
Figure 5:
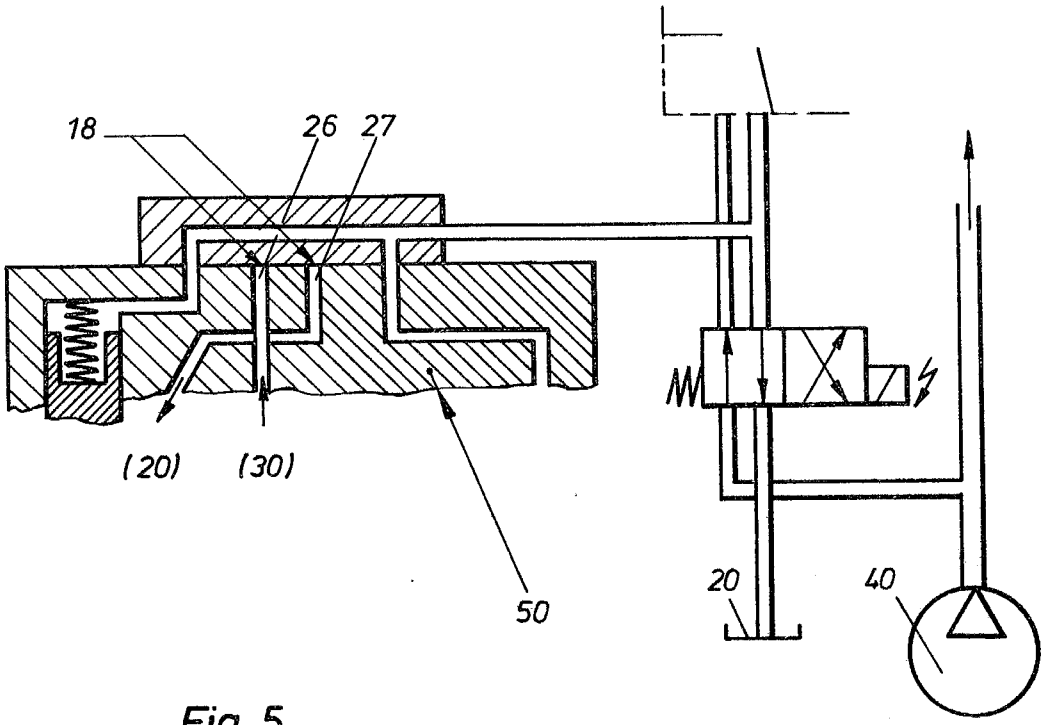
FIG. 5 shows the switching of the control connections of the controlled filling and discharge valve with remote control.

The operation is not endangered if pressure is effected from the delivery pump 40 instead of admission by the cylinder pressure $P_z$ because the latter is equal or smaller than the pump pressure. It is therefore possible to use a control valve which is already included in the control circuit of the machine in a parallel connected arrangement (FIG. 5) provided it is supplied from the delivery pump 40 and its switch positions adjust to the demands of the filling and discharge valve control. The control openings 26,27 of the filling and discharge valve 50 which correspond with the inlet and outlet connections of the built in control valve 14 are sealed and not used (FIG. 3) (sealed connections 15). The advantage: Additional economy.

2.4.2. Simultaneous control of two filling and discharge valves.

The control circuit arrangement as described under 2.4.1 ensures also an important advantage in the case of the use of two cylinder presses and bending presses as it provides for the simultaneous control of two or more filling and discharge valves.

2.4.3. Discharge of the delivery pump 40 during the decompression.

Under particularly heavy decompression conditions as in the case of very high pressures, high cylinder volumes, highly deformable machine frames or resilient tools it may be advantageous to keep the delivery pump 40 discharged during the decompression phase.

Figure 6:
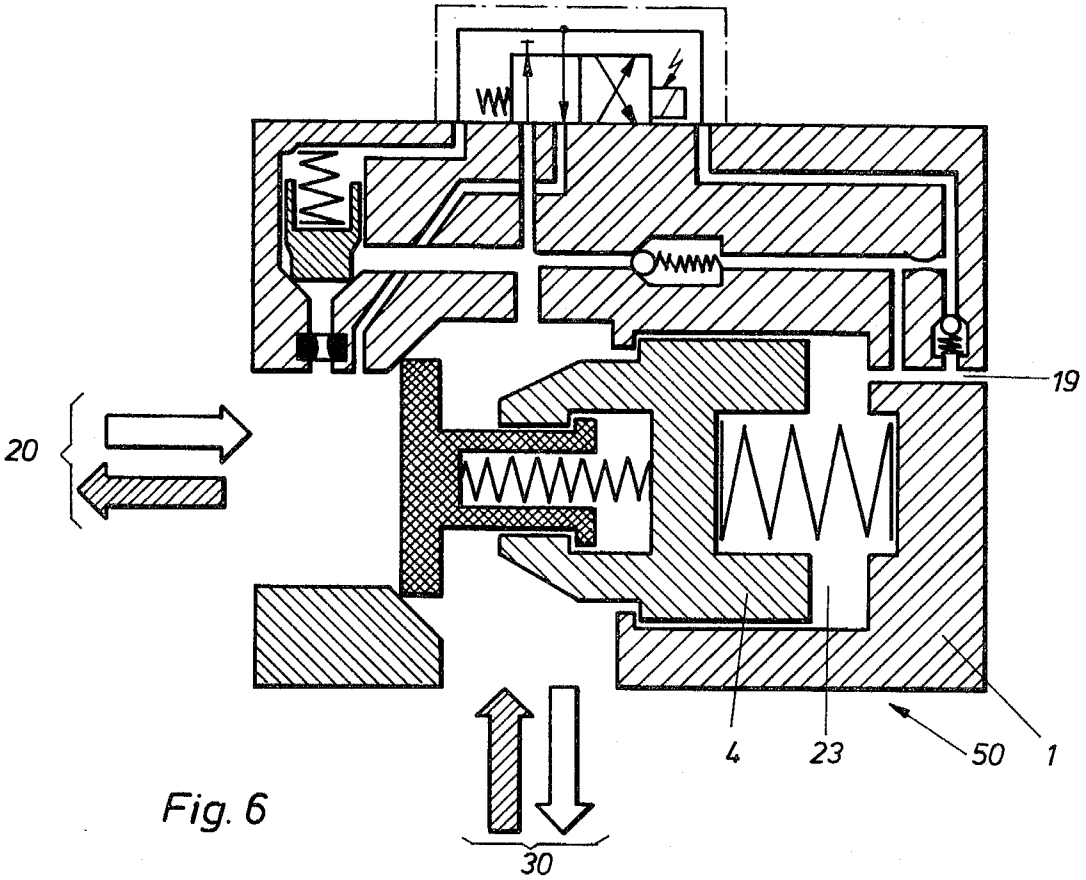
FIG. 6 shows the construction of a controlled filling and discharge valve with a connection opening for the diversion of a control signal.

The precontrol pressure $P_i$ as it exists in the valve cylinder chamber 23 of the main valve piston 4 can be derived through an opening 19 (FIG. 6) on the valve body 1 and used as a control signal in order to keep the delivery pump 40 discharged during the decompression as this drops immediately before the fall opening of the filling and discharge valve 50.

This property can be used with advantage in two cylinder presses or bending presses in order to synchronize the reversing and the return when the cylinders undergo different loadings and therefore the pressure levels at the end of the working stroke are also very different. In this case the precontrol pressures $P_i$ which are taken from each individual filling and discharge valve are guided as input signals in a change valve and its output signal is used as a discharge control for the pump. The duration of discharge is then determined by the longest decompression time.

I claim:

1. An improved filling and discharge valve for use with a hydraulic cylinder comprised of a working cylindrical chamber and a working piston contained therein, said valve adapted to effect prefilling of said cylindrical chamber with oil to provide rapid forward movement of the piston during a working cycle and for discharge of oil to an oil-storage means during a return stroke of said piston in completion of said working cycle, said valve comprising:

a valve body having first valve chamber (23) therein, a main valve piston (4) having an end portion slidably supported in said chamber with its other end portion extending from said chamber (23), said main valve piston having stop means at its end portion in cooperable relation with stop means (42) in said chamber (23), said main valve piston being biased in a forwardly position by a first spring means (5), a second valve chamber (22) located in said main valve extending portion, a second valve (2) comprising a seating plate portion and a stem portion extending into said valve chamber (22) and slidably biased in position by a second biasing spring means (3) maintained at a pretension less than that of said first biasing spring means (5), said stem within said chamber having stop means (38) at the end thereof which cooperates with stop means (37) in said chamber, said biasing spring means (3) being pretensioned so as to provide a gap (35) between said cooperable stop means and provide a firm seating of said valve plate against a corresponding seat leading to said oil-storage means, and so that valve (2) can be moved within the chamber and thus raised from its seat when pressure prevails in the working cylinder while the main valve piston (4) remains in contact with stop means (42) in said first valve chamber, the relative size of said main valve (4) piston and second plate valve (2) being such that the cross sectional working area of said main valve (4) is larger than the working area of said plate valve, such that the main valve piston (4) is caused to move away from stop means (42) and plate valve (2) is raised from its seat when the stop means (37) on said valve piston (4) contacts the stop means 38 on said valve stem (2) when excess pressure in the main valve cylinder (23) is released.

2. The filling and discharge valve according to claim 1, wherein control of the valve operation is achieved by means of a 3/2-way precontrol valve means (14) cooperably coupled to said valve body, said precontrol valve means (14) being cooperably coupled to a system including an oil-feeding line (26) and oil-return line (27) to control by additional valve means oil flow to said oil-storage means, said working cylinder and said filling and discharge valve, said system also including a consumer connection line (28) which is coupled to valve cylinder (23) by means of a channel (41) and a throttle (8) and in parallel a back pressure valve (9, 10) so that oil can flow freely from the 3/2-way pre-control valve (14) to the main valve cylinder chamber (23) and be throttled in the opposite direction.

3. The filling and discharge valve of claim 2, wherein a precontrol passage (25) is provided disposed between the working cylinder and the main valve cylinder (23), said passage (25) being provided with a counter pressure valve and spring (6, 7), the adjustment thereof being determined by spring tension.

4. The filling and discharge valve of claim 3, wherein a decompression passage is provided as a by-pass to plate valve (2), said decompression passage comprising a channel (24) and a series connected 2-way valve seat (11) and throttle (13), wherein the 2-way valve seat (11) is adapted to remain normally closed by a pretensioned spring 12 in control chamber (29), said chamber (29) being in hydraulic communication with consumer connection (28) of the 3/2-way precontrol valve (14).

5. The filling and discharge valve of claim 1, wherein the valve body has an opening through which oil is delivered, said opening communicating with the working cylinder to which the oil is delivered.

6. The filling and discharge valve according to claim 1, wherein the valve body has a control connection (19) which is coupled to the inside of the main valve chamber (23) of main valve (4) by means of which pressure is controlled so as to approach zero value during transition from decompression to discharge.

* * * * *